US006612252B2

(12) United States Patent
King et al.

(10) Patent No.: US 6,612,252 B2
(45) Date of Patent: Sep. 2, 2003

(54) COMBINATION REMOTE ADJUST FOOT BRACE AND RUDDER CONTROL

(75) Inventors: Todd Dean King, Greenville, SC (US); Charles Sagraves, Easley, SC (US)

(73) Assignee: Watermark Paddlesports, Inc., Easley, SC (US)

( * ) Notice: Subject to any disclaimer, the term of this patent is extended or adjusted under 35 U.S.C. 154(b) by 0 days.

(21) Appl. No.: 10/066,525

(22) Filed: Jan. 31, 2002

(65) Prior Publication Data

US 2002/0069809 A1 Jun. 13, 2002

Related U.S. Application Data

(63) Continuation of application No. 09/649,434, filed on Aug. 25, 2000, now abandoned.
(60) Provisional application No. 60/161,944, filed on Oct. 28, 1999.

(51) Int. Cl.[7] ..... B63H 25/00; B63B 35/00; B63B 17/00
(52) U.S. Cl. ..... 114/153; 114/347; 114/363
(58) Field of Search ..... 114/153, 347, 114/363

(56) References Cited

U.S. PATENT DOCUMENTS

| | | | | |
|---|---|---|---|---|
| 2,749,872 A | | 6/1956 | Amick | |
| 2,878,768 A | | 3/1959 | Warblow | |
| 3,844,243 A | | 10/1974 | Caton et al. | |
| 3,922,988 A | * | 12/1975 | Caton et al. | 114/165 |
| 3,982,293 A | | 9/1976 | Lagervall | |
| 4,556,006 A | * | 12/1985 | Kaupat | 114/162 |
| 4,589,365 A | | 5/1986 | Masters | |
| 4,621,587 A | * | 11/1986 | Pool | 114/39.26 |
| 4,727,821 A | | 3/1988 | Masters | |
| 4,744,327 A | | 5/1988 | Masters | |
| 4,942,840 A | | 7/1990 | Masters et al. | |
| 5,207,289 A | | 5/1993 | Wilmo | |
| 5,367,976 A | | 11/1994 | Van Schaik | |
| 5,624,356 A | | 4/1997 | Roberts | |
| 5,899,780 A | | 5/1999 | Robbins | |
| 5,921,197 A | | 7/1999 | Wagner | |
| 5,975,006 A | | 11/1999 | Lewit | |
| 6,047,656 A | * | 4/2000 | McKinley et al. | 114/163 |
| 6,112,692 A | * | 9/2000 | Lekhtman | 114/347 |

* cited by examiner

*Primary Examiner*—S. Joseph Morano
*Assistant Examiner*—Andrew Wright
(74) *Attorney, Agent, or Firm*—McNair Law Firm, P.A.; Cort Flint

(57) ABSTRACT

A convertible control system for a kayak having a first and second unit. The first unit comprises a guide mounted with each side of the hull forward of the seat. A mounting bar is carried by each guide with each mounting bar carrying a plate and a shaft adjacent one end and in substantially perpendicular relationship thereto. A locking member is associated with each guide for releasably locking each mounting bar in a selected position along the longitudinal axis of to the guide. The second unit comprises a rudder connected with the stern, a rudder pedal pivotally mounted with each guide by way of the shaft in a position normally spaced from the associated plate. A cable extends between each rudder pedal and the rudder, whereby movement of the rudder pedals results in a corresponding movement of the rudder.

24 Claims, 7 Drawing Sheets

Fig. 15
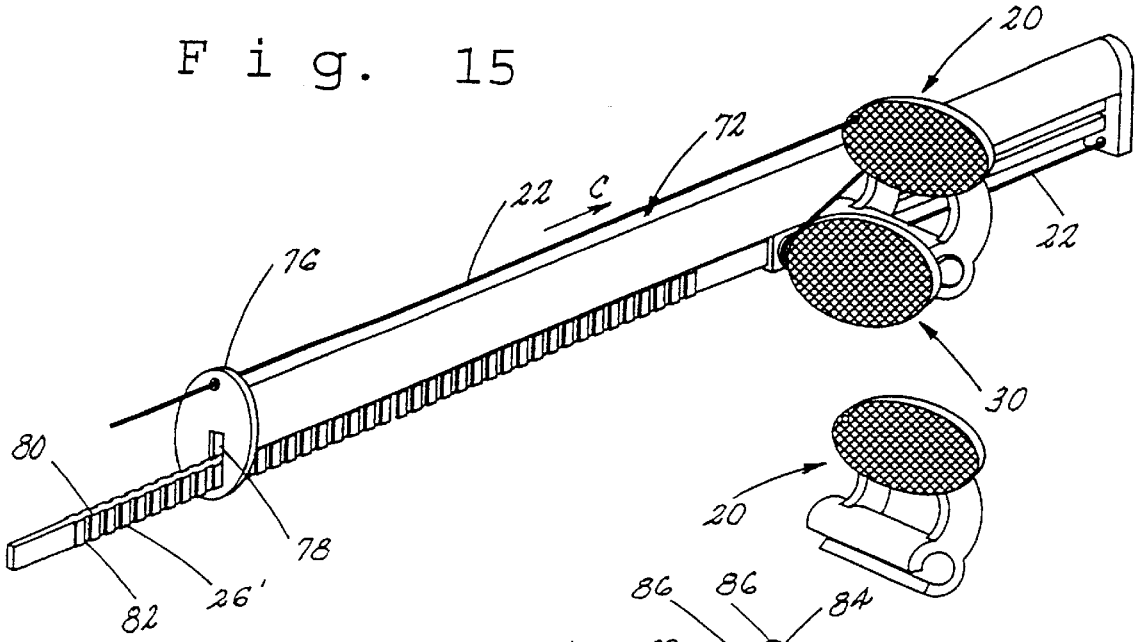
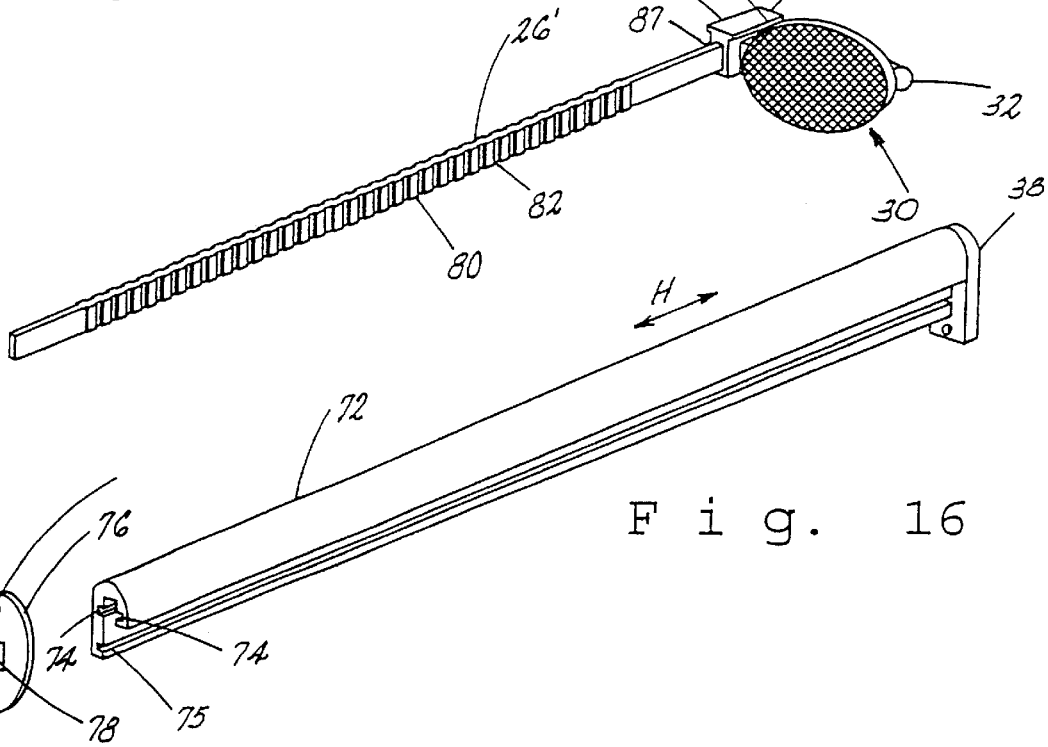
Fig. 16

COMBINATION REMOTE ADJUST FOOT BRACE AND RUDDER CONTROL

This application is a continuation of application Ser. No. 09/649,434, filed Aug. 25, 2000, now abandoned, which claims the benefit of Provisional application Ser. No. 60/161,944, filed Oct. 28, 1999.

BACKGROUND OF THE INVENTION

The instant invention is directed to a system of add on accessories for a kayak consisting of simple constructions which provide a plurality of functions. Specifically, the system consists of an adjustable foot brace or braces which may be adapted to carry a rudder pedal or pedals.

Adjustable foot braces for kayak's are known as are rudder assemblies which utilize rudder pedals. See U.S. Pat. No. 4,942,840.

It is an object of this invention to provide a foot pedal and foot pedal mounting arrangement which may be adapted to carry a rudder pedal and cable assembly.

Another object of the invention is an assembly at least partially comprised of molded plastic units.

Another object of the invention is to provide a multi-purpose accessory system which is easily adjustable by the paddler while seated.

Another object of the invention is to provide an inexpensive multi-purpose accessory system for kayaks.

SUMMARY OF THE INVENTION

This invention is directed to a convertible control system for a kayak. The system comprises a guide rail secured with and extending substantially parallel with the longitudinal axis of the hull of the kayak adjacent to its cockpit. A mounting bar, which is carried by the guide rail, carries a plate adjacent a first end thereof which acts as a foot brace. The plate is formed to have a substantially planar face and is carried by a support which includes a shaft. Locking members are provided for releasably locking the mounting bar in selected positions axially of the guide rail allowing the plate may be fixedly positioned in selected longitudinal positions relative to the seat. The mounting bar and plate may comprise an all plastic member or it may be part metal and part plastic.

The planar face of the plate may include centrally located pop-out pieces adjacent opposite sides of the shaft with the plate serving as a foot brace or rest. The pop-out pieces may be removed exposing the shaft so that it may serve as an axial mount for a rudder pedal when the rudder control is added.

The locking members may comprise a plurality of slots formed along at least one face of the mounting bar and at least one stationary finger. This structure allows one end of the mounting bar to be elevated above the finger freeing the mounting bar for axial movement relative the guide rail into a selected position. The mounting bar is then lowered so that the finger engages in an adjacent of the slots locking the mounting bar against axial movement.

The finger may be carried by a housing secured with the hull. The housing may include an opening which receives the mounting bar in position for the finger to engage with a selected slot. There may be a resilient member carried by the housing which urges the mounting bar in a downward direction or engaged. There may be a plurality of fingers within the openings with each finger being adapted to engage in a respective of the slots when the mounting bar is lowered.

The finger may comprise a vertically extending member or members and it may form a part of the guide rail.

The support may carry the shaft in horizontally spaced position of the plate. The shaft is designed to mount and serve as the pivotal axis for a rudder pedal. The rudder pedal includes a reinforcing finger or fingers which may include a horizontal opening which receives the these through shaft forming a pivotal mount for the rudder pedal.

The plate may include a slot extending downwardly from its upper edge which is located to receive an enlarged reinforcing finger. A selection of the reinforcing fingers may include a cable guide which carries the cable from an upper area of the rudder pedal about the horizontal shaft where it continues to be secured to an anchor.

The plate is designed to also serve as a stop against movement of the rudder pedal in one direction.

A combination control system having first and second units for use with a kayak having a hull with a stern and a cockpit with a seat.

DESCRIPTION OF A PREFERRED EMBODIMENT

The first unit includes a guide bar mounted with each side of the hull in a position forward of the seat. A mounting bar is carried by each guide and each mounting bar adjacent one of its ends carries a plate and a shaft which are arranged in substantially perpendicular relationship with the mounting bar. A locking member is arranged substantially adjacent a second end of each guide for releasably locking each mounting bar in a selected axial position relative to the guide.

The guide bar may include horizontally spaced guides and vertically spaced guides. Also, each plate and shaft may be carried by a frame having horizontally spaced followers and vertically spaced followers which are adapted to be slidably carried by the horizontally and vertically spaced guides.

The second unit includes a rudder connected with the stern of the kayak and a rudder pedal pivotally mounted with each of the shafts in positions spaced from the associated plates. A cable extending from each rudder pedal to opposed sides of the rudder so that movement of one of the rudder pedals in a first direction moves the rudder in the first direction and also moves the second of the rudder pedals in an opposite direction. The extent of this movement is limited by the plates.

The cables each engage with an upper area of a respective of the rudder pedals adjacent the hull. Each cable may extend forward from the upper area of the rudder pedal about the shaft to an anchor carried by the hull. Each plate may include a cable guide between its upper area and the shaft.

An elastic cord may be provided to extend between each upper area of the rudder pedal to the associated mounting bar. The elastic cords act to space each rudder pedal from its associated plate in a neutral, inactive position.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein:

FIG. 15 is a sectional perspective view of another arrangement of the remote adjustment system of the invention; and, FIG. 16 is an exploded perspective view of FIG. 15.

DESCRIPTION OF A PREFERRED EMBODIMENT

Figure 2:
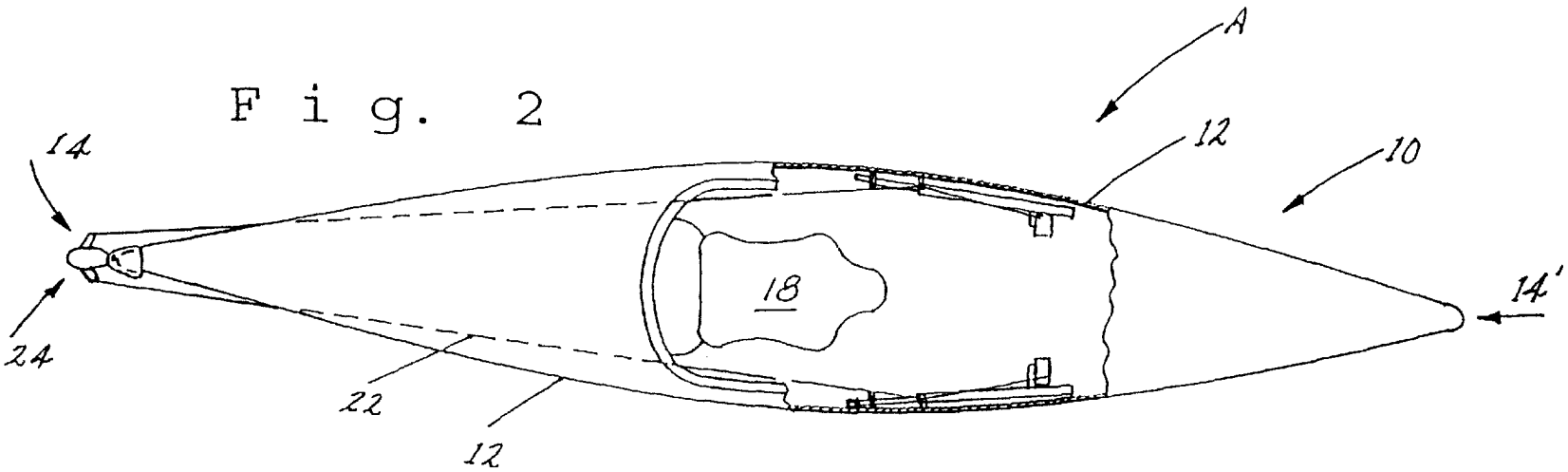
FIG. 2 is a top cutaway top schematic of a kayak fitted with the system of the invention.
Figure 1:
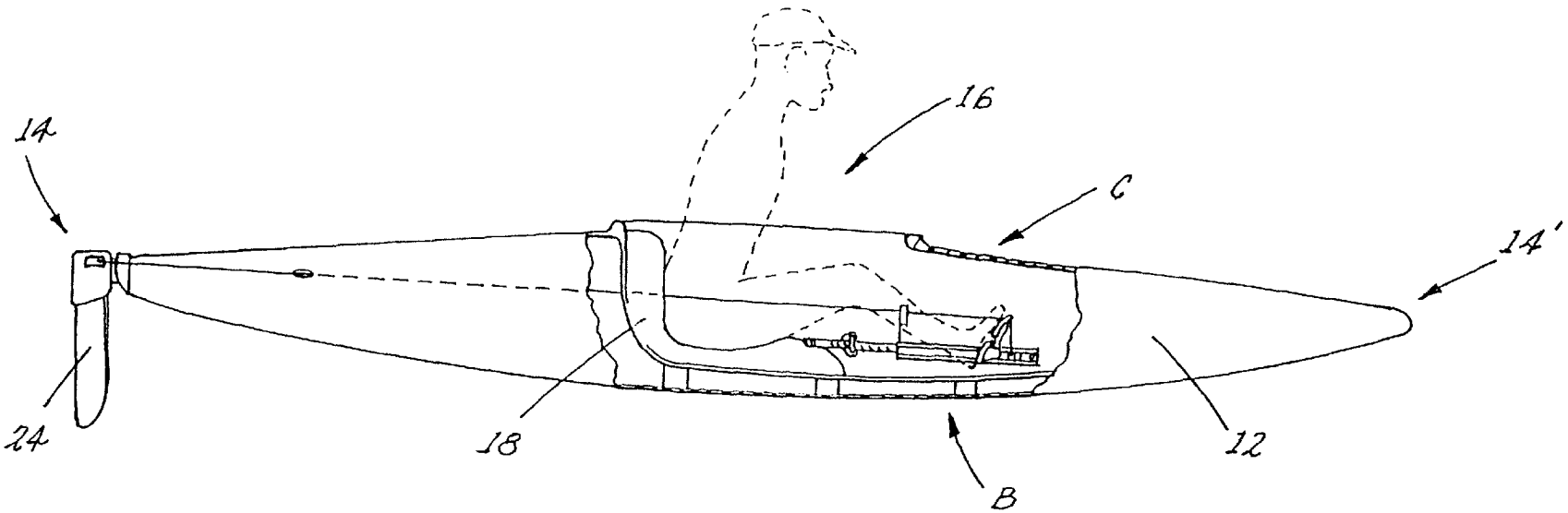
FIG. 1 is a cutaway side schematic view of a kayak fitted with an embodiment of the remote adjust foot support/rudder pedal system of the invention.

Turning now to the drawings, FIGS. 1 and 2 show generally a kayak 10 which includes a hull having opposed sides 12, a stern and bow 14, 14' and a cockpit 16. Seat 18 rests on the floor of the hull and is positioned in the rear of the cockpit. Mounted with opposed sides and substantially in the forward area of the cockpit 16 is the convertible remote adjust control system A of the invention shown in its second form which includes both adjustable foot braces B and adjustable rudder control C including rudder pedals 20 connected by way of cables 22 with rudder 24. It is important to note that adjustments to the foot braces and the rudder pedals can be made with the paddler in the seated position.

Figures 3, 4A, 4B, 5:
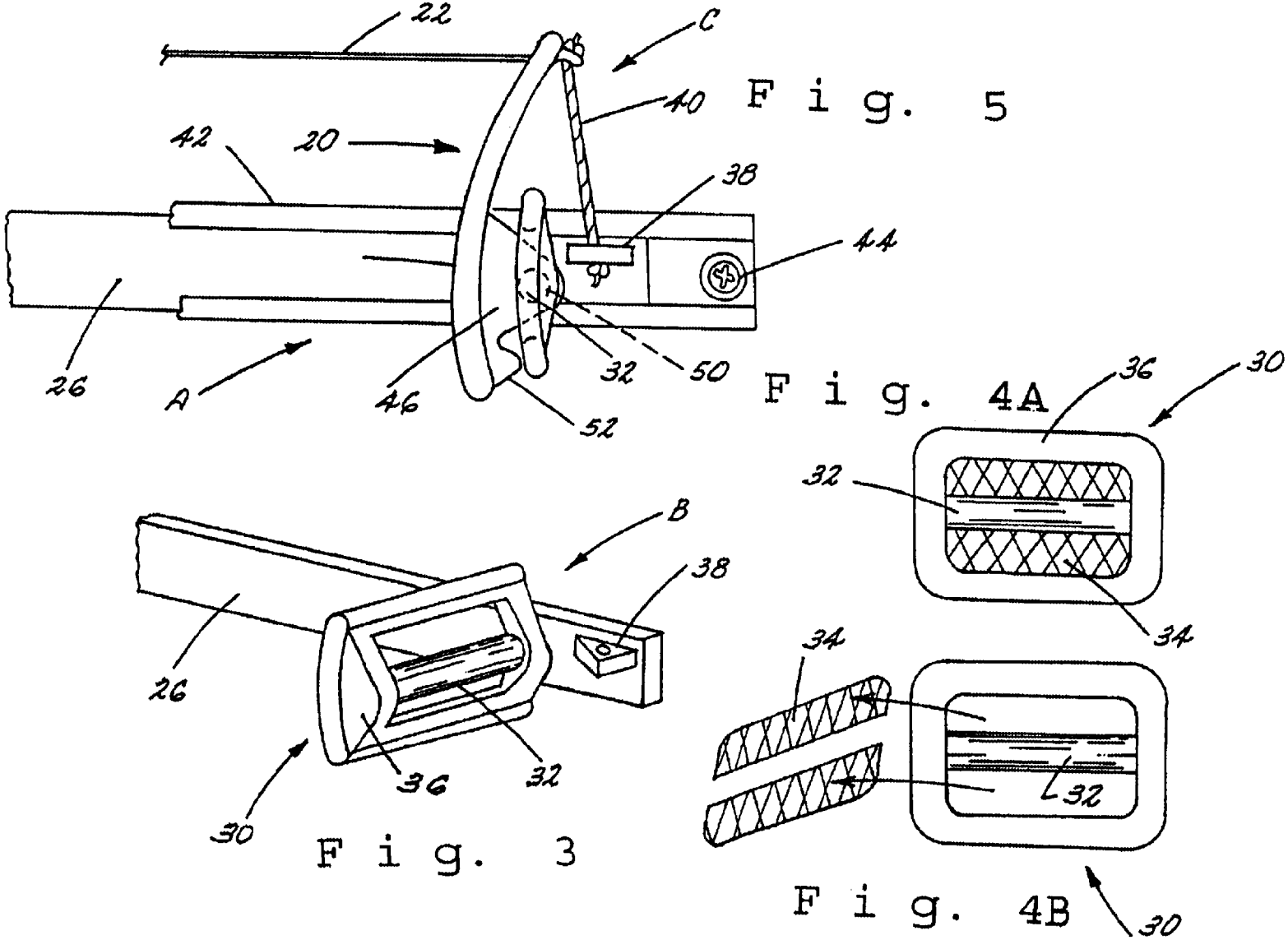
FIG. 3 is a sectional perspective view of a first arrangement of a foot brace of the invention.
FIG. 4*a* is a front view of the foot brace of FIG. 3.
FIG. 4*b* is an exploded view of the foot brace of FIG. 4*a* showing breakaway sections removed.
FIG. 5 is a sectional side view of the first arrangement remote adjust foot support in combination with a rudder pedal.

Turning now to FIGS. 3, 4, and 5, a first arrangement of control system A is shown. FIG. 3 shows a portion of the foot brace system B which includes a rectangular shaped mounting bar 26, support 36, plate 30, and shaft 32 adjacent one end. In this arrangement plate 30 includes a planar face formed by pop-out pieces 34 arranged along opposite sides of shaft 32 and connected with the peripheral surface of plate 30 as shown in FIG. 4*a*. Shaft 32 is carried by support member 36 relative to plate 30 as shown in FIG. 5. An anchor 38 is connected with mounting bar 26 between foot brace system B and the end of mounting bar 26. Plate 30 and shaft 32 are arranged in substantially perpendicular relationship with the longitudinal axis of mounting bar 26.

Preferably mounting bar 26, plate 30, and shaft 32 are formed integral of molded plastic. Alternatively, certain elements of this unit can be formed of metal while the remaining elements may be molded plastic.

Turning now to FIG. 5, the combined assembly of the control system is shown. In this arrangement, pop-outs 34 have been removed and a rudder pedal 20 has been pivotally mounted on shaft 32. Cable 22 is connected with an upper edge of pedal 20 and extends rearwardly through appropriate guides to connect with the rudder. Elastic cord 40 is also connected with the upper end of pedal 20 and with anchor 38. Cord 40 acts to maintain pedal 20 in a neutral position spaced from plate 30. It is noted cord 40 could be any type of resilient member which carries out the same function.

Mounting bar 26 is slidably mounted in guide rail 42 which is mounted with a side of the hull by at least one bolt 44. In the arrangement described, bolt 44 pivotally mounts guide rail with the side. In other arrangements the guide rail is mounted in fixed position relative to the hull.

Rudder pedal 20 can be of any selected design. In the particular arrangement shown, a pair of support fingers 46 which project from the back side of elongate members 48 are provided. An opening 50 is provided in each finger to receive shaft 32. An ear or stop 52 is provided on a lower portion of member 48 in a location to engage with plate 30 and limit movement of rudder pedal 20 in one direction.

In use, the foot brace system B is connected with each side of the hull and may be used as an independent unit with a rudderless kayak. With a kayak having a rudder, the foot brace system B serves as the mounting structure for the rudder control assembly C.

Figure 6:
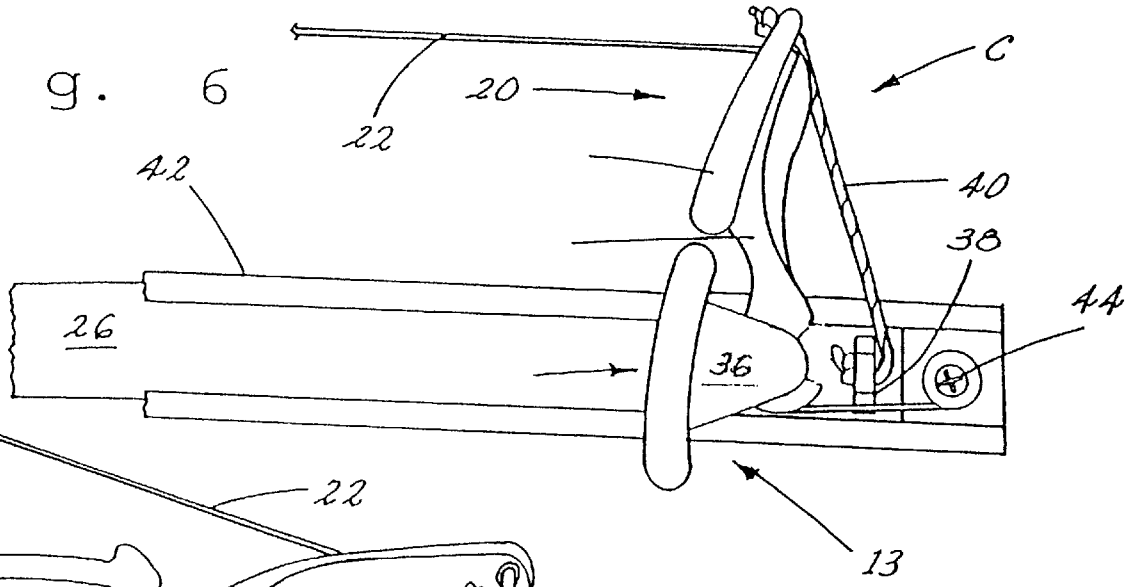
FIG. 6 is a sectional side view of another arrangement of the remote adjust foot brace/rudder pedal combination of the invention.
Figure 7:
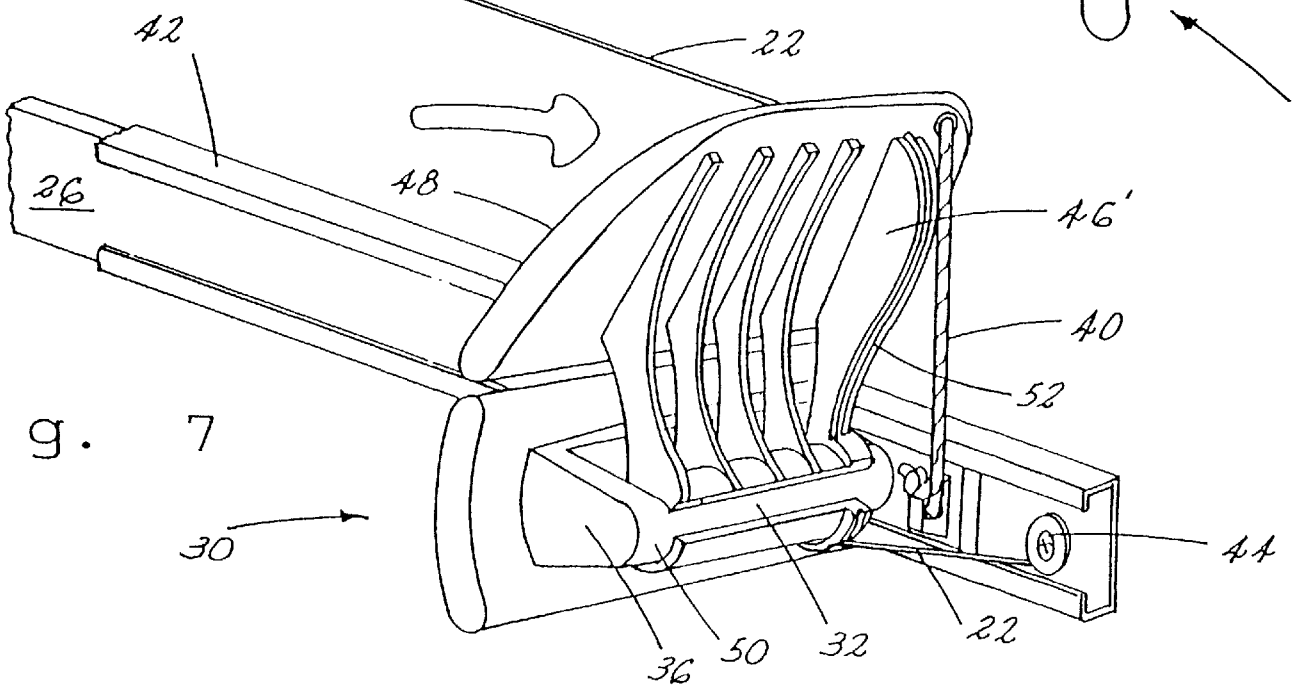
FIG. 7 is a sectional perspective view of the arrangement of FIG. 6.

FIGS. 6 and 7 show slight variations of the arrangements shown in FIGS. 3, 4, and 5. Again mounting bar 26 is carried for longitudinal movement by guide rail 42 which is mounted with the hull by bolt 44. The foot brace system includes plate 30 and shaft 32 secured with mounting remote adjust rod 26. In this instance support 36 locates shaft 32 longitudinally spaced from the rear surface of plate 30.

Rudder pedal 20 is formed with fingers 46 which extend downwardly from elongate member 48 and form a bearing or opening 50 at their lower end. Opening 50 pivotally receives shaft 32. Elastic cord 40 extends between anchor 38 and the upper end of pedal 20.

Pedal 20 has a guide groove 52 formed in an end most support finger 46'. Rudder cable 22, in this arrangement, passes through an opening in the upper edge of pedal 20, down through groove 52, about shaft 32 and is secured with bolt 44. Cable 22 extends in the opposite direction to be connected with the rudder. As the pedal is adjusted, the cable slides within this groove continuously maintaining tension between the rudder, pedal 20 and bolt 44.

Again, plate 30 serves as a stop to limit movement of rudder pedal 20 in one direction. In this case fingers 46 position rudder pedal over plate 30 so that its upper surface acts as a stop.

Figure 9:
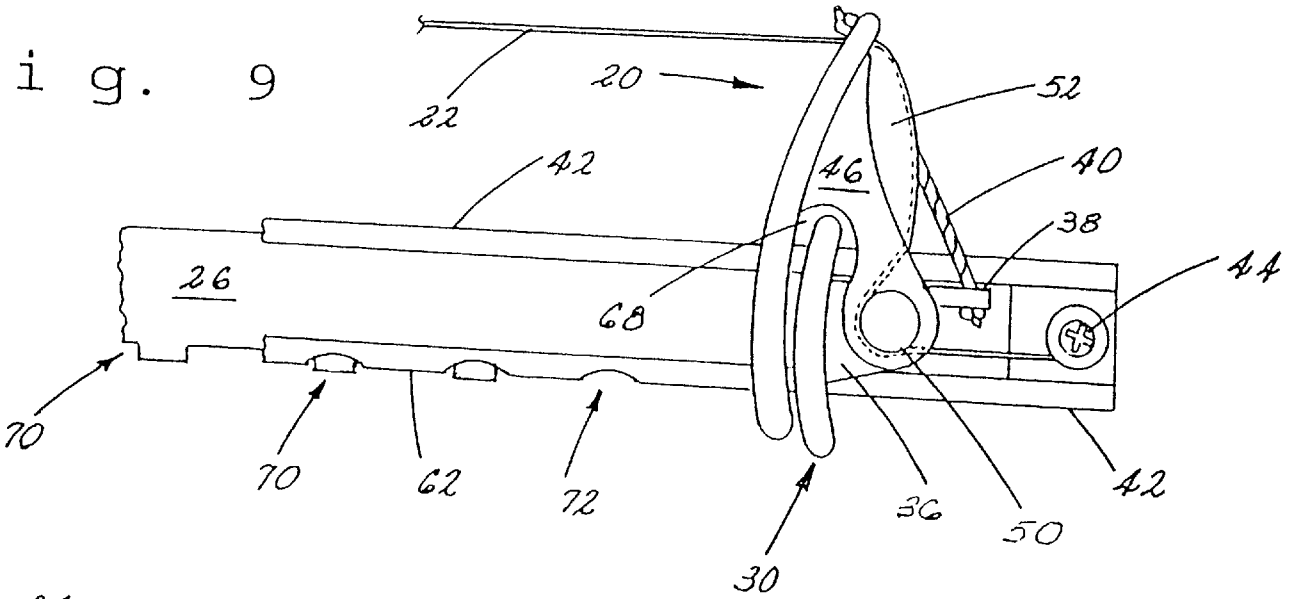
FIG. 9 is a cutaway side view of an alternative arrangement of a remote adjust foot brace/rudder pedal utilizing the foot brace of FIG. 8.
Figure 8:
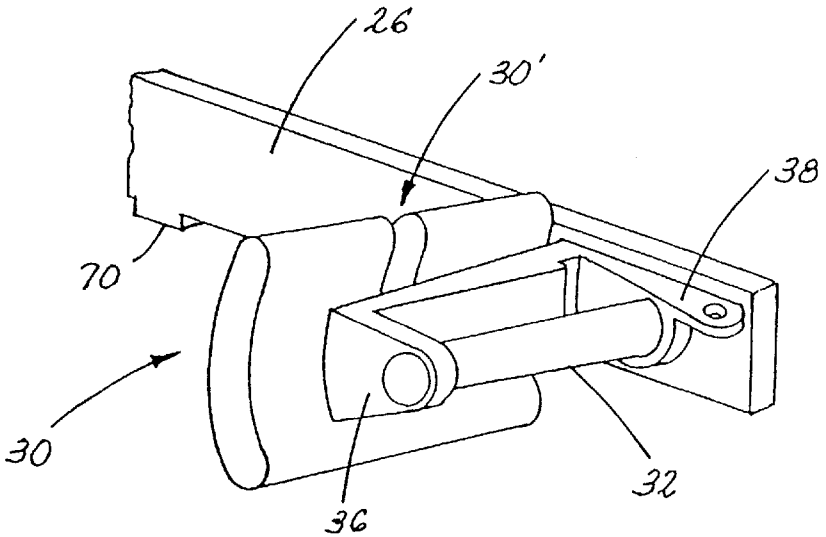
FIG. 8 is a sectional perspective view of an alternative arrangement of FIG. 3.

FIGS. 8 and 9 show slightly varied forms of the control system of FIGS. 3–7. In this arrangement support 36 is positioned vertically centrally of plate 30 and is formed to include anchor 38. Plate 30 is mounted on one side of support 36 and shaft 32 on the opposite side thereof. A vertical slot 30' is formed centrally of plate 30 and extends from about its midpoint through its upper edge. As before the plate, support and shaft are integral and are connected to one side and adjacent an end of mounting bar 26. Mounting bar 26 is carried by guide rail 42 and is adjustable longitudinally of the kayak.

The structure thus far described may function as one of a pair of foot braces. Should a rudder assembly be attached, rudder pedal 20 is mounted on shaft 32, cable 22 is connected to an upper end and passes in groove 52 to be anchored at 44. Support fingers 46 are formed on the rear surface of pedal 20 and extend downwardly to form opening 50 at their lower ends. Pedal 20 is which pivotally mounted on shaft 32 in similar fashion to the previously described arrangements. An additional support is formed centrally of pedal 20 in the form of web 68 which extends downwardly to be about even with the upper level of opening 50.

When the rudder pedal 20 is mounted with the mounting assembly, web 68 is located to pass through slot 30'. Again, the upper surface of plate 30 and of slot 30' act as stops against movement of the rudder pedal in one direction.

Also shown in FIGS. 8 and 9 is a locking arrangement for allowing remote adjust mounting bar 26 to be shifted longitudinally of hull 12 and locked into positions at desired distances from seat 18. This locking arrangement comprises a plurality of locking members in the form of teeth 70 formed along the lower surface of mounting bar 26. A corresponding number of engagement elements in the form of apertures 72 separated by fingers 62 are formed along the lower surface of guide rail 42. To lock the mounting bar in position, the bar is allowed to be at rest on guide rail 42 with certain of teeth 70 aligned with and extending through apertures 72 to be engaged by fingers 62. To adjust its longitudinal position, the mounting bar 26 is raised at its free end so that teeth 70 are located above apertures 72. In this position, mounting bar 26 may be moved longitudinally relative to guide rail 42 and the hull. When in the newly selected position, the bar is lowered to engage teeth 70 with apertures 72. To hold the remote adjust mounting bar in the locking position a downward force is applied via a spring or other elastic mechanism.

In this arrangement guide rail 42 is secured in fixed position with hull 12 with a bolt 44 at each of its end.

Figure 10:
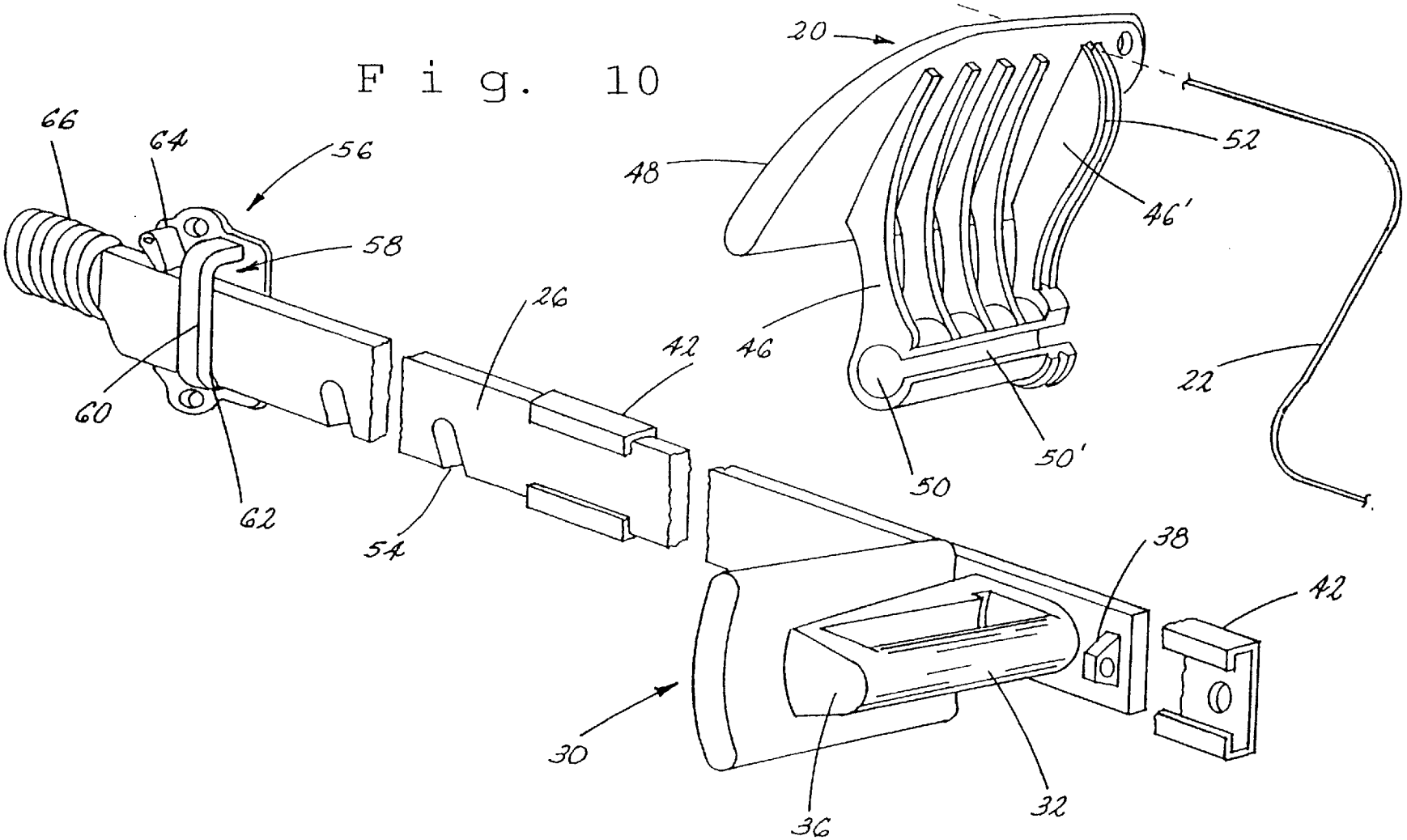
FIG. 10 is an exploded perspective view of another arrangement of the remote adjust foot brace/rudder pedal assembly of the invention.
Figures 11, 12, 13, 14:
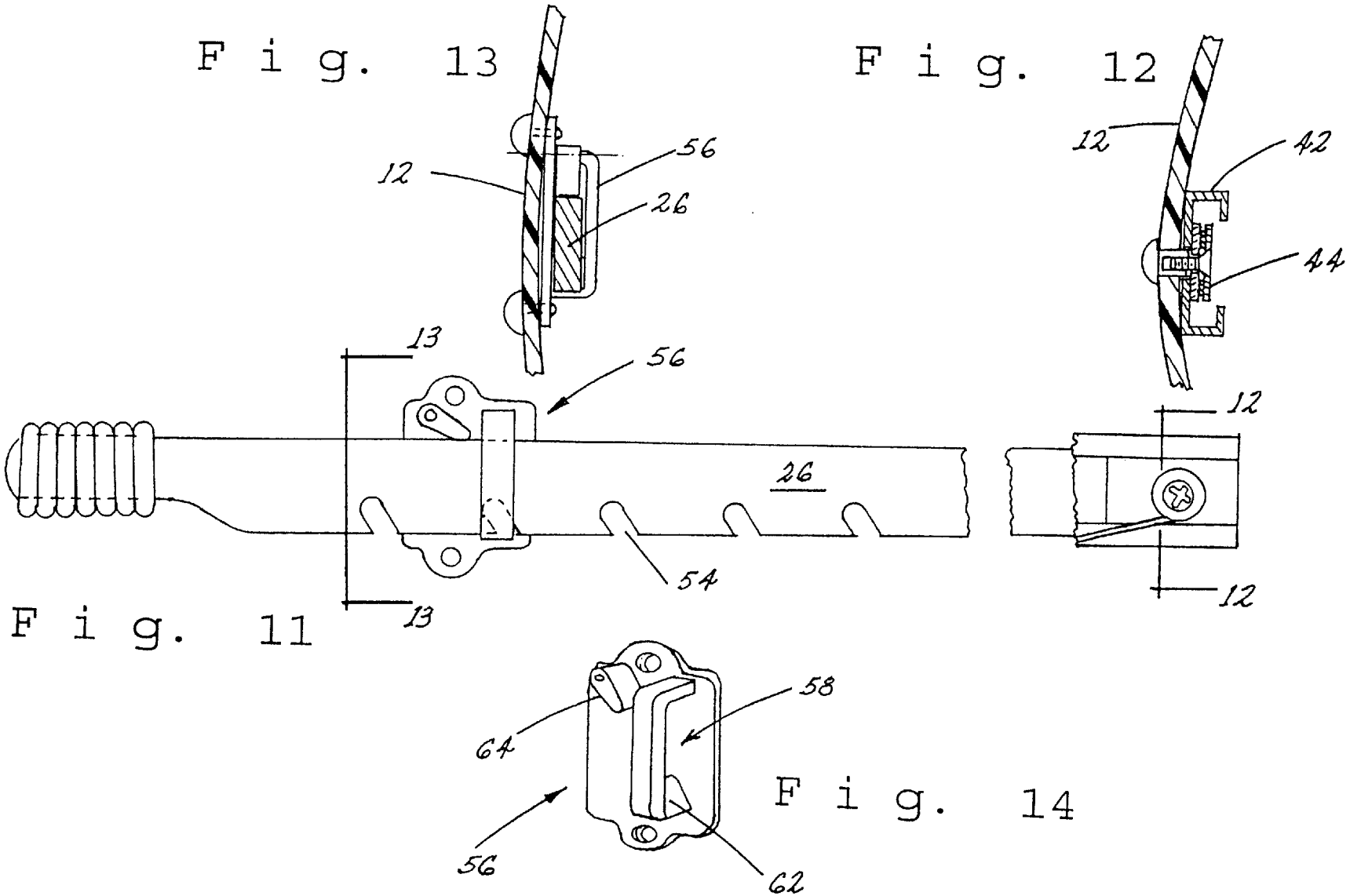
FIG. 11 is a sectional side view of a mounting bar locking mechanism for use with the system of the invention.
FIG. 12 is a sectional view taken along lines 12—12 of FIG. 11.
FIG. 13 is a sectional view taken along lines 13—13 of FIG. 11.
FIG. 14 is an exploded view of a housing of the remote adjustment locking mechanism of FIG. 12.

FIG. 10 shows the arrangement of FIGS. 6 and 7 in exploded form with support 36, plate 30 and shaft 32 connected with mounting shaft 26 adjacent one end thereof and with rudder pedal 20 positioned above this assembly. Gap 50' which extends across support fingers 46 provides access for shaft 32 into opening 50.

FIGS. 10–14 show clearly that mounting remote adjust bar 26 extends beyond guide rail 42 in position for easy reach from the paddler's hand from the seated position within the kayak. Adjacent the free grip end 66 of mounting bar 26 there are formed a plurality of locking members in the form of downwardly projecting slots 54 formed along its lower edge. Housing 56 which is secured with a side of hull 14 receives the free end of mounting bar 26 through opening 58 formed by U-shaped member 60. The lower portion of member 60 forms an engagement element in the form of a substantially horizontal finger 62 which extends substantially horizontally and perpendicularly of mounting bar 26. Finger 62 is received in a selected slot 54 to lock mounting bar in a selected position against movement longitudinally of the hull. Finger 62 can also be an integral with extension 42, preferably connected with the end of guide rail 42 which is adjacent grip end 66.

Housing 56 also includes a keeper 64 adjacent the upper edge of opening 58. Keeper 64 is resiliently urged in a downward direction to engage with an upper surface of mounting bar 26. The keeper acts to retain finger 62 engaged in slot 54. This keeper 56 can be located separate of housing 56 in any position along the bar 26 depending on the amount of adjustment desired.

FIGS. 15 and 16 show another modified arrangement of the control system of the invention. In this arrangement guide rail 72 is fixedly secured with hull 12. Guide rail 72 is formed with a pair of horizontally spaced longitudinal C-shaped guides 74 and a third longitudinal guide 75 vertically spaced below the inner one of guides 74. A cap 76 having a T-shaped opening 78 is secured with one end of guide rail 72.

Mounting bar 26' is provided with locking members in the form of vertical teeth 80 separated by vertical slots 82. The end of bar 26' opposite the end carrying teeth 80 is connected with slide 84. Slide 84 includes a pair of horizontally spaced followers 86 and a third follower 87 which is vertically spaced below the inner one of followers 86. Followers 86, 87 are adapted to slidably fit into C-shaped guides 74, 75 for longitudinal movement only along guide rail 72.

Plate 30 and shaft 32 are fixed with slide 84 and are operable to serve as a foot brace. The longitudinal position of the foot brace assembly may be adjusted by raising the exposed end of bar 26' to allow teeth 80 to move from between the lower, vertical edges of an engagement element in the form of a T-shaped opening 78 into the space formed by the horizontal opening, freeing teeth 80 and allowing longitudinal movement of mounting bar 26' and slide 84. When the bar is lowered to position the edges of the vertical portion of the T-shaped slot between adjacent of the vertical teeth, the bar is locked against longitudinal movement. Preferably a resilient member is mounted within rail 72 and acts to maintain bar 26' in the locked position.

When desired, a rudder assembly may be added with rudder pedal 20 being pivotally mounted on shaft 32 as described above. Rudder cable 22 connects with an upper portion of the rudder pedal and passes rearwardly through eyelet 88 in cap 76 to be connected with the rudder. A resilient member may be added to maintain rudder pedal 20 spaced from plate 30 in the neutral position as earlier described. The plate acts as a stop against further movement of the rudder pedal in one direction, also as earlier described.

In practice, the kayak is normally equipped with none of the elements of the described control system. If a foot brace is desired, a guide rail is secured with the hull of the kayak as described and a mounting bar is fitted therein. The plate against which the foot presses is positioned in selected longitudinal position by moving the mounting bar longitudinally of the hull. When in position the bar is locked against movement.

When a rudder assembly is desired, the rudder is attached to the stern of the hull and cables are run up the opposite sides thereof. Rudder pedals are attached with the shafts associated with each plate and the cable is attached with upper ends of each rudder pedal.

Movement of one pedal in one direction applies force to the other pedal in an opposite direction. The plates may act to limit movement of each pedal in one direction which effectively limits movement of both pedals in both directions. Optimal rudder movement is 16° but the system provides for up to 30° movement in each direction and can be adjusted according to desired paddling style.

The rudder cable may be fixed forward of each rudder pedal. This allows longitudinal adjustment of the rudder pedal without having to change the attachment of the rudder cable.

While a preferred embodiment of the invention has been described using specific terms, such description is for illustrative purposes only, and it is to be understood that changes and variations may be made without departing from the spirit or scope of the following claims.

What is claimed is:

1. A foot brace control system for guiding a kayak of the type having a hull and a cockpit with a seat in which a boater is accommodated and a rudder for guiding the kayak in the water, said system comprising:

longitudinal guide rails carried by said hull on opposing sides of said cockpit extending generally in the direction of a longitudinal axis of said hull;

elongated adjustable mounting bars slidably carried by said longitudinal guide rails;

foot plates carried by said mounting bars adjacent first ends thereof, said foot plates having a bracing face for engagement by feet of the boater;

locking members associated with said mounting bars for releasably locking said mounting bars in selected positions axially of said guide rails so that said foot plates may be fixedly positioned in selected longitudinal positions relative to said seat; and said locking members comprising a plurality of locking members formed along at least one surface of said mounting bars and at least one complimentary stationary engagement element carried by one of said hull and said guide rails so that said mounting bar may be disengaged from said engagement element, moved axially of said guide rail into a selection position to engage another of said locking members with said engaging element fixing said mounting bar against axial movement.

2. The system of claim 1 wherein said mounting bars and foot plates comprise a unitary plastic member.

3. The system of claim 2 including shafts extending from said mounting bars, wherein said foot plates are carried by said shaft and include centrally located pop-out pieces adjacent said shaft, said foot plates serving as foot braces.

4. The system of claim 3 wherein said pop-out pieces may be removed so that said shaft is exposed; and including a rudder pedal mounted to said exposed shaft.

5. The system of claim 1 wherein said mounting bars include at least one anchor between said first ends and said foot plates.

6. The system of claim 1 including a resilient member urging said mounting bars in a downward direction.

7. The system of claim 1 wherein said at least one stationary element comprises an engagement opening adapted to engage with a respective of said locking members when said mounting bars are lowered.

8. The system of claim 1 wherein said engagement elements are carried by second ends of said guide rails.

9. The system of claim 1 including rudder pedals carried with said foot plates by said mounting bars; and rudder cables operatively connected with said rudder pedals and the rudder of the kayak.

10. The system of claim 9 wherein said foot plates include slots extending downwardly from their upper edges, and said rudder pedals include reinforcing webs received in said slots.

11. The system of claim 9 wherein said rudder cables are routed through upper portions of said rudder pedals.

12. The system of claim 11 including cable guides, said rudder cables being routed through said rudder pedals along said cable guides; and including anchors to which said rudder cables are affixed after exiting said cable guides.

13. The system of claim 12 wherein said rudder pedals are pivotally carried by said adjustable mounting bars in association with said foot plates, and said rudder cables are routed through said rudder pedals in a self-adjusting manner so that a cable tension on said rudder pedals is maintained as said mounting bars are adjusted in their longitudinal position.

14. The system of claim 13 including resilient members engaging with said rudder pedals, said resilient members acting to maintain said rudder pedals in a neutral position.

15. A foot brace rudder control system for a kayak having a rudder to control the kayak's direction, said kayak being of the type having a hull with a stern and cockpit with a cockpit seat for accommodating a boater, wherein said system comprises:

longitudinal guide rails mounted on opposing sides of an interior of said hull forward of said cockpit seat;

adjustable mounting bars carried by said guide rails;

foot plates carried by said mounting bars to provide a foot brace for said boater in said kayak;

locking members associated with said adjustable mounting bars for affixing said mounting bars in one of a plurality of longitudinal positions relative to the hull;

rudder pedals pivotally carried by said mounting bars in association with said foot plate; and rudder cables routed from the rudder of the kayak to said rudder pedal so that pivotal movement of said pedals operates the rudder to guide the kayak.

16. The system of claim 15 wherein said rudder cables are routed through said rudder pedals in a self-adjusting manner so rudder tension is maintained by said rudder pedals when said mounting rails are adjusted in their longitudinal position.

17. The system of claim 16 wherein said self-adjusting routing of said rudder cables includes routing passages through upper portions of said rudder pedals, cable guides for routing said rudder cables behind said rudder pedals, directional guides for changing the direction of said rudder cables as said rudder cables leave said rudder pedals, and anchors for affixing said rudder cables after leaving said rudder pedals.

18. The system of claim 15 wherein said foot plates are carried by shaft supports and said rudder pedals are pivotally carried on said shaft supports.

19. A foot brace rudder control system for a kayak having a rudder to control the kayak's direction, said kayak being of the type having a hull with a stern and a bow, a rudder carried by the stern, and a cockpit with a cockpit seat for accommodating a boater disposed between the stern and bow of the hull, wherein said system comprises:

foot plates carried on interior sides of the hull forward of said cockpit seat to provide a foot brace for said boater seated in said cockpit seat;

adjustable mounts for mounting said foot plates to the interior sides of the hull at one of a plurality of adjustable longitudinal positions along the interior sides;

pivotal supports carried by said adjustable mounts;

rudder pedals being pivotally carried by said pivotal supports; and rudder cables extending from the rudder of the kayak to said rudder pedals so that movement of said rudder pedals operate said rudder to guide the kayak.

20. The system of claim 19 wherein said foot plates are secured to said adjustable mounts by means of support shafts and said rudder pedals are detachably and pivotally carried by said support shafts.

21. The system of claim 20 wherein said rudder pedals include channel openings which receive said support shafts of said adjustable mounts whereby said rudder pedals are pivotally carried by said adjustable mounts, and said channel openings include a slot by which said rudder pedals may be attached to said support shafts.

22. The system of claim 19 wherein said rudder cables are routed through said rudder pedals in a self-adjusting manner so rudder tension is maintained by said rudder pedals when said mounting bars are adjusted in their longitudinal position.

23. The system of claim 22 wherein said self-adjusting routing of said rudder cables includes routing passages through upper portions of said rudder pedals, cable guides for routing said rudder cables behind said rudder pedals, directional guides for changing the direction of said rudder cables as said rudder cables leave said pedals, and anchors for affixing said rudder cables after leaving said rudder pedals.

24. The system of claim 23 including tension cords connected to said rudder pedals at one end and affixed stationarily at a second end to maintain said rudder pedals in neutral positions.

* * * * *